US006193799B1

(12) United States Patent
Eriksson

(10) Patent No.: US 6,193,799 B1
(45) Date of Patent: Feb. 27, 2001

(54) DEVICE FOR APPLICATION OF GLUE ON OBJECTS

(75) Inventor: Tore Eriksson, Klässbol (SE)

(73) Assignee: BTG Källe Inventing AB, Säffle (SE)

( * ) Notice: Subject to any disclaimer, the term of this patent is extended or adjusted under 35 U.S.C. 154(b) by 0 days.

(21) Appl. No.: 09/171,171

(22) PCT Filed: Apr. 17, 1997

(86) PCT No.: PCT/SE97/00653

§ 371 Date: Oct. 14, 1998

§ 102(e) Date: Oct. 14, 1998

(87) PCT Pub. No.: WO97/38797

PCT Pub. Date: Oct. 23, 1997

(30) Foreign Application Priority Data

Apr. 19, 1996 (SE) ..... 9601485

(51) Int. Cl.[7] ..... B05C 1/04

(52) U.S. Cl. ..... 118/261; 118/211; 118/212; 118/249; 118/413

(58) Field of Search ..... 118/250, 258, 118/259, 261, 100, 211, 212, 249, 304, 413; 427/428; 101/153, 154, 155, 157

(56) References Cited

U.S. PATENT DOCUMENTS

| | | | | |
|---|---|---|---|---|
| 1,942,383 | * | 1/1934 | Pickhunt et al. | 118/250 X |
| 2,199,228 | * | 4/1940 | Obenshaw et al. | 118/259 X |
| 2,271,801 | * | 2/1942 | Morrison et al. | 118/259 X |
| 3,018,757 | * | 1/1962 | Loppnow | 118/259 X |
| 3,952,700 | * | 4/1976 | Little, Jr. et al. | 118/259 X |
| 4,675,208 | * | 6/1987 | Kageyana et al. | 118/259 X |
| 4,821,672 | | 4/1989 | Bruno . | |
| 4,844,002 | * | 7/1989 | Yasui et al. | 118/259 |

FOREIGN PATENT DOCUMENTS

| | | |
|---|---|---|
| 1079058 | 6/1980 | (CA) . |
| 0037682A1 | 10/1981 | (EP) . |
| 0557635A1 | 9/1993 | (EP) . |

* cited by examiner

*Primary Examiner*—Laura Edwards
(74) *Attorney, Agent, or Firm*—Burns, Doane, Swecker & Mathis, L.L.P.

(57) ABSTRACT

Device for the application of a coating composition on a traveling web (17) comprising a transfer roll (5), a support roll (3) cooperating with the transfer roll (5), the traveling web being fed in a nip between said rolls, further comprising a gravure roll (7) intended for the transfer of an adapted quantity of the coating composition onto the transfer roll (5), and a device for passing of the web through said nip, characterized by a blade device (11, 13) for the removal of excess of coating composition from the gravure roll (7), said blade device being arranged in trailing position in relation to the moving surface of the gravure roll (7).

20 Claims, 1 Drawing Sheet

DEVICE FOR APPLICATION OF GLUE ON OBJECTS

The present invention relates to a device for the application of a coating composition on a travelling web, particularly a paper web. The device is of the type comprising a transfer roll, a support roll cooperating therewith, the web travelling in a nip between said rolls. The device further comprises a gravure roll intended for the application of an adapted quantity of the coating composition on the transfer roll for further transfer to the travelling web.

A traditional so called flexo coater has for a function to transfer onto a travelling paper web a predetermined layer defined by a gravure roll. This gravure roll is via a dosage roll supplied with an excess of a composition which is pressed into the valleys of the gravure roll, and with a blade or a doctor 5 the excess composition on the gravure roll is removed so that after this doctoring step only the valleys of the gravure roll are filled with composition. From the gravure roll the material is transferred onto a transfer roll which in turn moves the material over to the surface of the paper web. In the prior art the composition is contained in a van, wherein the dosage roll is dipped into the composition and transferred therefrom to the dosage nip between the dosage roll and the gravure roll. In the traditionally designed flexo coaters the blade or doctor is of a so called pushing type which is mainly used in all applications where the function is to scrape a travelling surface, for example a roll surface. In the present case the surface of the gravure roll is to be scraped clean so that the present composition only is found in the valleys of the gravure roll.

An important area of use for flexo coaters is the application of microcapsules in the manufacture of so called NCR-paper.

An example of a modified form of flexo coaters is found in EP-A1 0 037 682 where, as is clear from figure An example of a modified form of flexo coaters is found in EP-A1 0 037 682 where, as is clear from FIG. 1, the gravure roll is dipped into the coating composition, the excess composition being removed by means of a pushing doctor in a conventional manner.

The present invention has for its object to improve the function of the flexo coater in several respects.

One object of the present invention is to improve the function of the doctor with regard to wear of the gravure roll.

Another object is to provide reduced wear of the doctor blade.

Yet another object is to provide better filling of the valleys of the gravure roll.

Yet an object of the invention is to provide reduced deposition onto the doctor blade and thereby reduced risk for scratches in the coating composition subject to dosage.

Another object of the invention is to eliminate the problem of sedimentation in the fountain tray.

For these and other objects which will be clear from the following disclosure the present invention provides for a device for the application of a coating composition on a travelling web, particularly a paper web. The device comprises a transfer roll, a support roll cooperating with the transfer roll, and the travelling web is fed in a nip between said rolls. The device further comprises a gravure roll intended for the transfer of an adapted quantity of the coating composition onto the transfer roll for further conveyance to the travelling web. In addition, the device according to the invention comprises means for passing of the web through said nip.

The device according to the invention is characterized by blade means for the removal of excess of coating composition from the gravure roll, said blade means being arranged in trailing position in relation to the moving surface of the gravure roll.

In a preferred embodiment of the invention said blade means is arranged under an angle in relation to the moving surface of the gravure roll of less than about 45°. A preferred angle is from about 10 to about 30°.

The device according to the invention is suitably provided with application means for the application of the coating composition on the moving surface of the gravure roll upstream of said blade means. This applicatin means comprises in one embodiment a tube extending across the full width of the travelling web and being provided with a slit or a row of nozzles extending along said tube. On the other hand the application means can comprise a dosage roll cooperating with the gravure roll to the formation of a pool of coating composition upstream of said blade means.

The device according to the present invention is suitably provided with a fountain tray for the recovery of excess coating composition. It is furthermore suitable that the movable surfaces of the rolls move pair-wise in the same direction.

The invention is particularly applicable to the coating of paper webs. It is furthermore particularly preferred to use said device according to the invention for the application of coating compositions containing microcapsules used in carbon-free copying paper.

The invention will in the following be described by non-limiting examples in association with the appended drawings, wherein.

Figure 1:
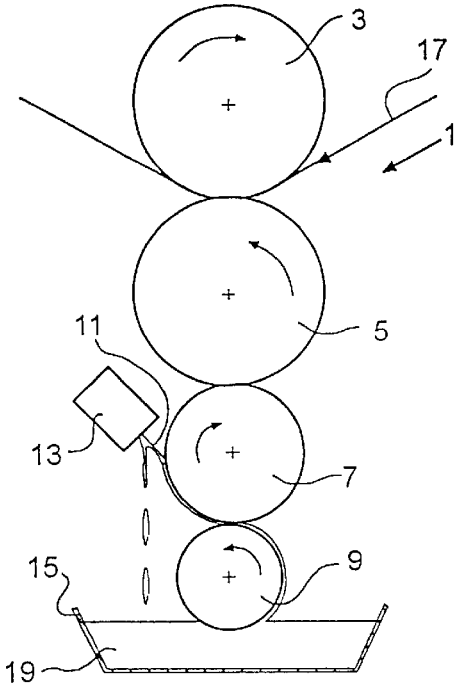
FIG. 1 shows diagrammatically in a sideview a conventional flexo coater according to known techniques.

FIG. 1 shows diagrammatically a traditional so called flexo coater generally designated 1 for one-sided coating of a travelling paper web 17. This flexo coater consists of a number of main components, namely a support roll 3 and a transfer roll 5, between which the paper web 17 travels in the direction indicated in the figure. The flexo coater furthermore comprises a gravure roll 7 having a patterned surface, and a dosage roll 9. The coating composition 19 is contained in a fountain tray 15 wherein the dosage roll 9 with its lower part rotates in the coating composition 19.

With the flexo coater in operation coating composition is picked up with a dosage roll 9 and transferred to the surface of the gravure roll 7. The excess of coating composition is removed by means of a doctor blade 11 carried in a blade holder 13. This doctor blade is arranged in a pushing position in relation to the rotating gravure roll 7. Coating composition is volumetrically transferred from the gravure roll 7 onto the transfer roll 5 for further conveyance to the lower side of the travelling web 17.

The dipping procedure for pickung up the coating composition by means of the dosage roll 9 in accordance with prior art involves inconveniences in connection with the presence of the composition in the fountain tray 15. The coating composition used in the above described area for the manufacture of NCR-paper consists of a dispersion containing lighter and heavier particles. In view of this sedimentation in the traditional dipping trays occurs and particles assemble in the areas of the tray where the liquid flow is low.

The inconveniences arising hereby can be eliminated by the device according to the present invention, which will be clear from the following disclosure.

Figure 2:
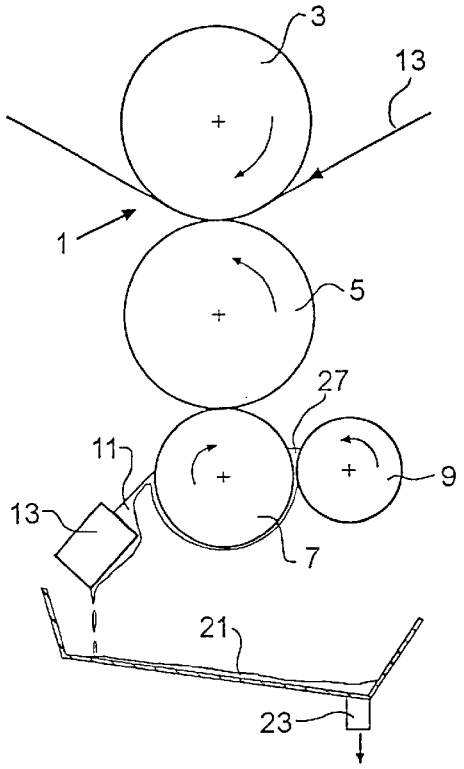
FIG. 2 shows diagrammatically in a sideview an embodiment of the coating device according to the present invention.

The embodiment of the device according to the present invention shown in FIG. 2 operates according to certain other principles. The device shown in FIG. 2 contains as before a support roll 3 and a transfer roll 5, between which rolls the paper web 17 is transported in the direction shown. Furthermore, the device contains a gravure roll 7 and a dosage roll 9 cooperating therewith. Instead of using fountain tray 15 in accordance with known techniques and as shown in FIG. 1 there is applied, however, in the device according to FIG. 2 the formation of a pond 27 above the nip between the gravure roll 7 and the dosage roll 9, and the excess of metered amount of coating composition 19 is then removed by means of a doctor blade 11 arranged on a carrier 13. However, this doctor blade is, as is clear from FIG. 2, arranged in trailing position vis-à-vis the patterned surface of the gravure roll 7. In this manner certain advantages are gained which are described further below. The device according to FIG. 2 has at the lower part thereof an assembly tray with an outlet 23 for collecting excess coating composition.

Figure 3:
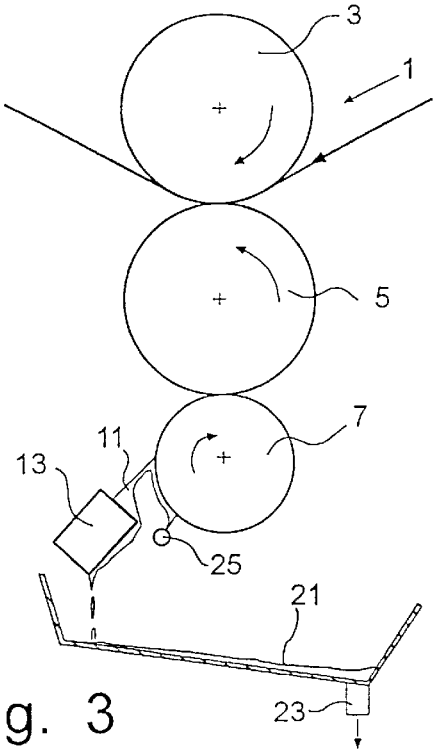
FIG. 3 shows a corresponding alternative embodiment of the device according to the present invention.

The modified embodiment shown in FIG. 3 largely corresponds to that of FIG. 2 except that the dosage roll 9 has been replaced by an application means 25 consisting of an application tube extending along the gravure roll 7 and being provided with discharged nozzles over its whole length for transferring coating composition onto the surface of the gravure roll 7 by suitable pre-dosage. As before excess of this composition is removed by means of a trailing doctor blade 11.

Figure 4:
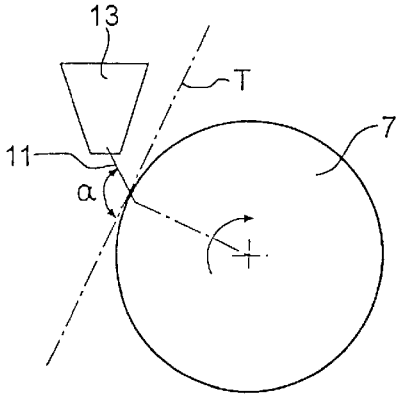
FIG. 4 shows diagrammatically the angular relation between the doctor blade and the gravure roll.

FIG. 4 shows diagrammatically in a sideview the relation between doctor blade 11 and gravure roll 7 with regard to the position of doctor blade 11. The angle $\alpha$ between a plane through the doctor blade 11 and a tangent through the point of engagement of the doctor blade 11 against the gravure roll 7 corresponds at a value exceeding 90° so called pushing position of the doctor blade 13, whereas in angle $\alpha$ lower than 90° corresponds to trailing position of the blade.

The use of a blade angle $\alpha$ exceeding 90° corresponding to pushing position of blade 11 involves certain disadvantages among which the following can be mentioned:

Pushing position results in high wear of the doctor blade and also high wear on the gravure roll.

Furthermore, pushing position results in the formation of deposits of dried coating composition on the front or exit side of doctor blade 11.

In the techniques according to the present invention a doctor blade is used in trailing position, i.e. the angle $\alpha$ is less than 90° and is preferably less than about 45° and lies particularly within the range about 10 to about 30°. When using this blade geometry a hydrodynamic fluid pressure will be generated in the wedge behind the blade. This fluid pressure results in a certain lifting force on the blade which can be balanced against the outer force on the blade so that a fluid film can be created between the highest points of the roll surface and the blade. In this manner the metallic contact between doctor blade and roll will be eliminated or considerably reduced which, of course, is essential from the point of view of wear.

The hydrodynamic pressure in the wedge behind the doctor blade also assists in effectively pressing the coating composition into the valleys of the roll surface, whereby complete filling of the valleys will be ensured. The use of a trailing blade also reduces the problem of deposits on the exit side of the blade which results in improved eveness of the metered film.

Even if the invention has been described above in association with specific embodiments it should be observed that the invention is in no way restricted hereto, since modifications and changes are obvious to skilled artisans. Therefore, the invention is restricted only in accordance with the appended patent claims.

What is claimed is:

1. Device for the application of a coating composition on travelling web, comprising:

a transfer roll;

a support roll cooperating with the transfer roll, the travelling web being fed in a nip between the transfer and support rolls;

a gravure roll for transfer of an adapted quantity of a coating composition onto the transfer roll;

a blade for removal of excess of coating composition from the gravure roll, the blade being arranged in a trailing position in relation to the moving surface of the gravure roll and under an angle $\alpha$ in relation to the moving surface of the gravure roll of less than 45°; and non-dipping application means for transfer of coating composition onto the moving surface of the gravure roll upstream of the blade.

2. Device according to claim 1, wherein the blade is arranged under an angle $\alpha$ in relation to the moving surface of the gravure roll of between 10 to 30°.

3. Device according to claim 1, wherein the application means comprises a tube extending over a whole width of the travelling web and being provided with at least one of a slit and a row of nozzles extending along the tube.

4. Device according to claim 1, comprising a dosage roll cooperating with the gravure roll to form a pond of coating composition upstream of the blade.

5. Device according to claim 1, comprising a fountain tray for recovering excess coating composition.

6. Device according to claim 1, wherein the moving surfaces of the transfer, the support, and the gravure rolls move in the same direction at nips between the transfer and the support rolls and between the transfer and the gravure rolls.

7. Device according to claim 1, wherein the travelling web is a paper web.

8. Device according to claim 1, wherein the coating composition contains microcapsules used in carbonless copying paper.

9. Device according to claim 2, wherein the application means comprises a tube extending over a whole width of the travelling web and being provided with at least one of a slit and a row of nozzles extending along the tube.

10. Device according to claim 2, comprising a dosage roll cooperating with the gravure roll to form a pond of coating composition upstream of the blade.

11. Device according to claim 9, comprising a dosage roll cooperating with the gravure roll to form a pond of coating composition upstream of the blade.

12. Device according to claim 2, comprising a fountain tray for recovering excess coating composition.

13. Device according to claim 3, comprising a fountain tray for recovering excess coating composition.

14. Device according to claim 4, comprising a fountain tray for recovering excess coating composition.

15. Device according to claim 2, wherein the moving surfaces of the transfer, the support, and the gravure rolls move in the same direction at nips between the transfer and the support rolls and between the transfer and the gravure rolls.

16. Device according to claim 3, wherein the moving surfaces of the transfer, the support, and the gravure rolls move in the same direction at nips between the transfer and the support rolls and between the transfer and the gravure rolls.

17. Device according to claim 2, wherein the traveling web is a paper web.

18. Device according to claim 3, wherein the traveling web is a paper web.

19. Device according to claim 2, wherein the coating composition contains microcapsules used in carbonless copying paper.

20. Device according to claim 3, wherein the coating composition contains microcapsules used in carbonless copying paper.

* * * * *